US010744801B2

(12) United States Patent
Fernandez Guinea et al.

(10) Patent No.: US 10,744,801 B2
(45) Date of Patent: Aug. 18, 2020

(54) HOLDER DEVICE FOR A PRINTER

(71) Applicant: Hewlett-Packard Development Company, L.P., Houston, TX (US)

(72) Inventors: Joseba Fernandez Guinea, Sant Cugat del Valles (ES); Daniel Gutierrez Garcia, Sant Cugat del Valles (ES); Roger Terradellas Callau, Sant Cugat del Valles (ES); Marcos Arminana Terrasa, Sant Cugat del Valles (ES); Oriol Moliner Rafa, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/084,339

(22) PCT Filed: Mar. 18, 2016

(86) PCT No.: PCT/EP2016/055912
§ 371 (c)(1),
(2) Date: Sep. 12, 2018

(87) PCT Pub. No.: WO2017/157452
PCT Pub. Date: Sep. 21, 2017

(65) Prior Publication Data
US 2019/0100043 A1 Apr. 4, 2019

(51) Int. Cl.
*B41J 13/24* (2006.01)
*B41J 11/06* (2006.01)

(52) U.S. Cl.
CPC ..... *B41J 13/24* (2013.01); *B41J 11/06* (2013.01)

(58) Field of Classification Search
CPC ..... B41J 13/24; B41J 11/06
See application file for complete search history.

(56) References Cited

U.S. PATENT DOCUMENTS 5,534,902 A 7/1996 Hoesly
6,109,806 A 8/2000 Asano
(Continued)

FOREIGN PATENT DOCUMENTS

CN 1868756 11/2006
CN 102211467 10/2011
(Continued)

*Primary Examiner* — Sharon A. Polk
(74) *Attorney, Agent, or Firm* — HP Inc. Patent Department

(57) ABSTRACT

A tensioner device for use with a printing device is described which is to hold an end of a print target holder sheet in a substantially planar configuration across a platen of a printing device. The tensioner device can be fixed to a frame attachable to a platen of a printing device. The tensioner device has a first surface, and the frame has a second surface corresponding to the first surface. The first surface is formed to slide along the second surface in a first direction having an oblique angle with respect to a plane of the print target holder sheet. A fixing mechanism is also described which allows the first surface to be fixed to the second surface at different positions along the first direction. An apparatus including the tensioner device and the frame is also described. A system including a printer, a platen, tensioner devices and frames is also described.

13 Claims, 6 Drawing Sheets

(56) References Cited

U.S. PATENT DOCUMENTS

| | | | | |
|---|---|---|---|---|
| 6,334,726 | B1 * | 1/2002 | Nakanishi | B41J 11/06 400/648 |
| 8,292,421 | B2 | 10/2012 | Mandel et al. | |
| 8,505,890 | B2 | 8/2013 | Toya | |
| 8,556,408 | B2 | 10/2013 | Matsuya | |
| 8,870,330 | B1 * | 10/2014 | Borrell Avila | B41J 3/4078 347/16 |
| 9,707,777 | B1 * | 7/2017 | Faundez | B41J 11/0045 |
| 2010/0209169 | A1 | 8/2010 | Mandel | |
| 2011/0025796 | A1 * | 2/2011 | Matsuya | B41J 11/0005 347/104 |
| 2011/0050826 | A1 | 3/2011 | Katagami et al. | |
| 2013/0136521 | A1 | 5/2013 | Garcia et al. | |
| 2016/0023481 | A1 | 1/2016 | Gracia Verdugo et al. | |

FOREIGN PATENT DOCUMENTS

| | | |
|---|---|---|
| JP | 2004 090538 A | 3/2004 |
| JP | 2004090538 | 3/2004 |
| JP | 2004 230839 | 8/2004 |
| JP | 2011046485 | 3/2011 |
| WO | WO-2006060042 | 6/2006 |
| WO | WO-2009018631 | 2/2009 |

* cited by examiner

HOLDER DEVICE FOR A PRINTER

BACKGROUND

In some printers, a print target is disposed on a platen in a printing zone. A device may be used to hold the print target in place. For example, an edge holder strip may be placed across an edge of the print target, and fixed to opposing ends of the platen.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1A:
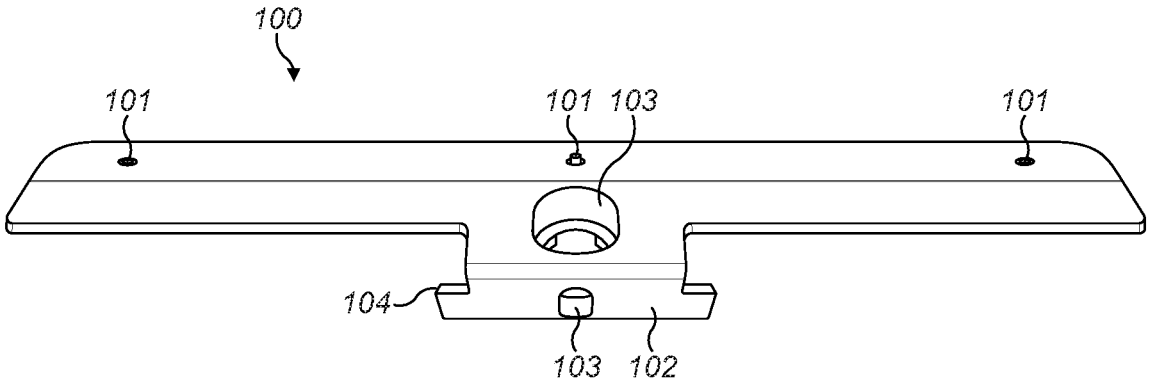
FIG. 1*a* is a schematic diagram of a tensioner device according to an example.
Figure 1B:
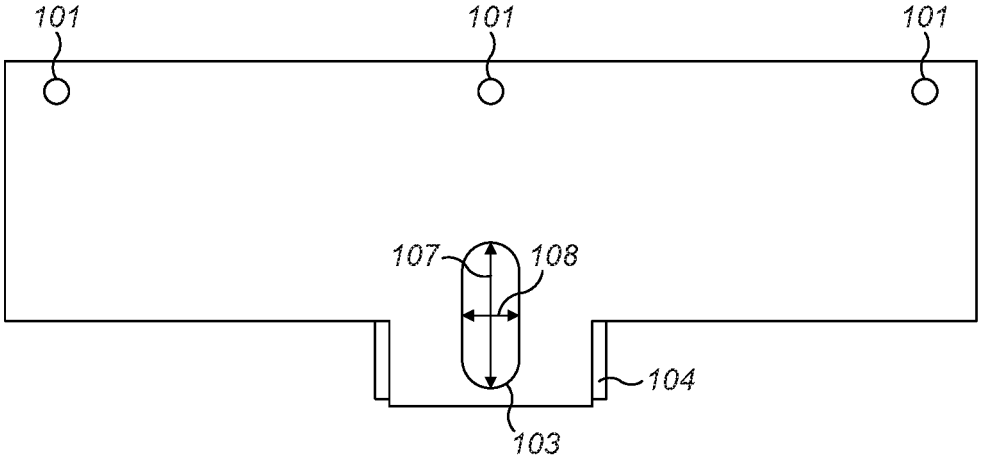
FIG. 1*b* is a schematic diagram of the example tensioner device of FIG. 1*a*, viewed from a top-down perspective.
Figure 1C:
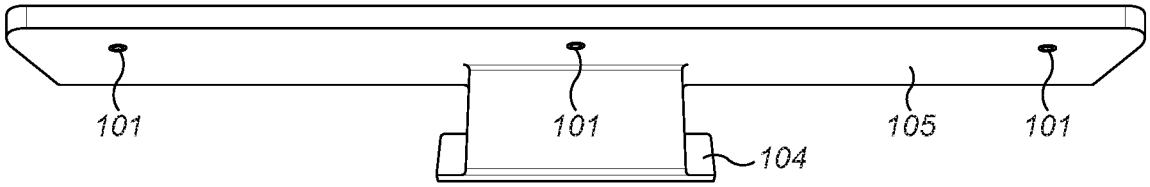
FIG. 1*c* is a schematic diagram of the example tensioner device of FIG. 1*a*, viewed from a rear perspective.
Figure 1D:
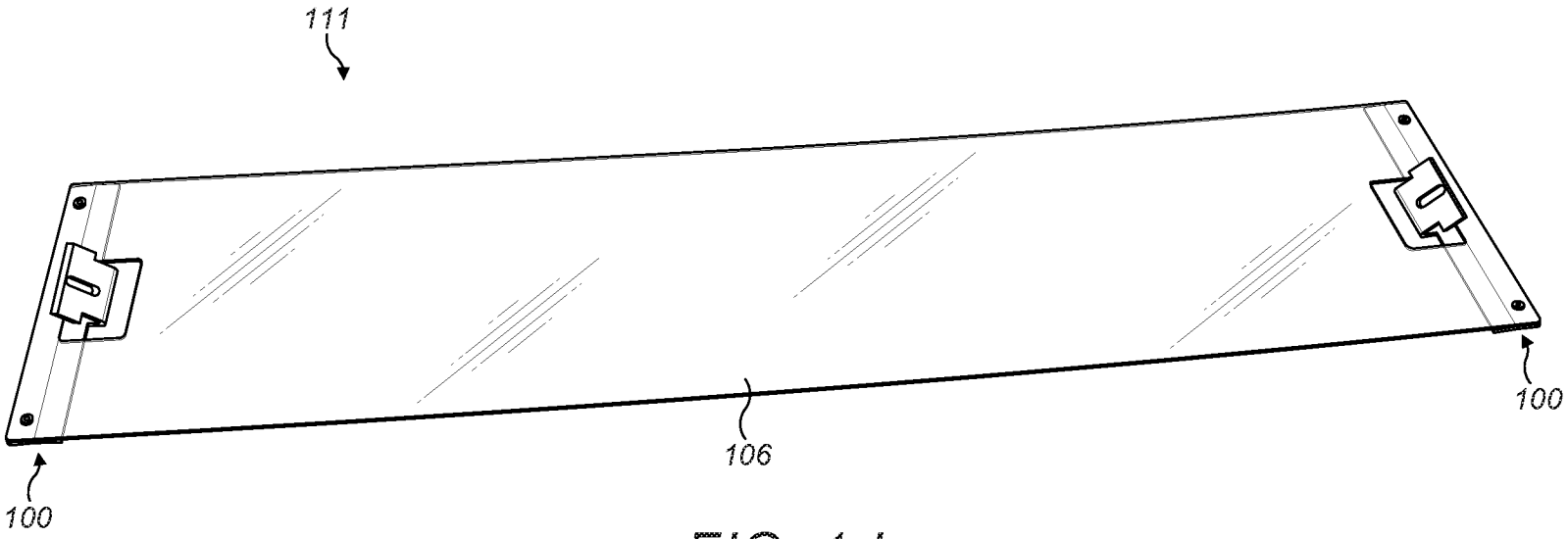
FIG. 1*d* is a schematic diagram of a pair of tensioner devices according to an example, with the tensioners holding opposite ends of a print target holder sheet, from a bottom up perspective.

FIGS. 1*a*, 1*b* and 1*c* schematically illustrate a tensioner device 100 (referred to herein as a tensioner 100) according to an example. FIG. 1*d* schematically illustrates a strip assembly 111 comprising a print target holder sheet 106 (referred to hereinafter as an edge holder strip 106) held at opposing ends by respective tensioners 100. FIGS. 1*a, b, c* and *d* as well as other figures referenced herein, are schematic diagrams and as such certain components have been omitted to facilitate a description of the example. Actual implementations may vary in practice.

The tensioner 100 includes a holder 101 suitable for holding one end of an edge holder strip 106. In the example of FIG. 1, the holder 101 comprises three threaded holes capable of receiving screws in order to fix an end of the edge holder strip 106 on to the bottom surface 105 of the tensioner 100. However, in other examples, a different number of screws, or a different holding mechanism may be used.

The edge holder strip 106 is for holding an edge of a print target on a platen of a printing device. A print target may be, for example, a print media substrate such as paper or flexible card, or any other target suitable for printing.

In this example, the tensioner 100 has an angled surface 102, the angled surface 102 having an oblique angle with respect to the plane of the edge holder strip 106 when the edge holder strip 106 is held in the holder 101.

Further, in this example, the tensioner 100 includes a fixing mechanism 103 comprising a receiving hole 103 passing through the tensioner 100 for receiving a screw. The receiving hole 103 may have an elongate cross section as illustrated in FIG. 1*b*. The elongate cross section of the receiving hole 103 has a length in a direction substantially perpendicular to the edge of the edge holder strip 106 when held in the holder 101. The elongate hole 103 also has a width 108, substantially perpendicular to the length 107 and shorter than the length 107. The receiving hole 103 is formed such that it passes through the angled surface 102 of the tensioner 100. In this example, the angled surface 102 is on a front surface of a protruding part 104 of the tensioner 100.

Figure 2A:
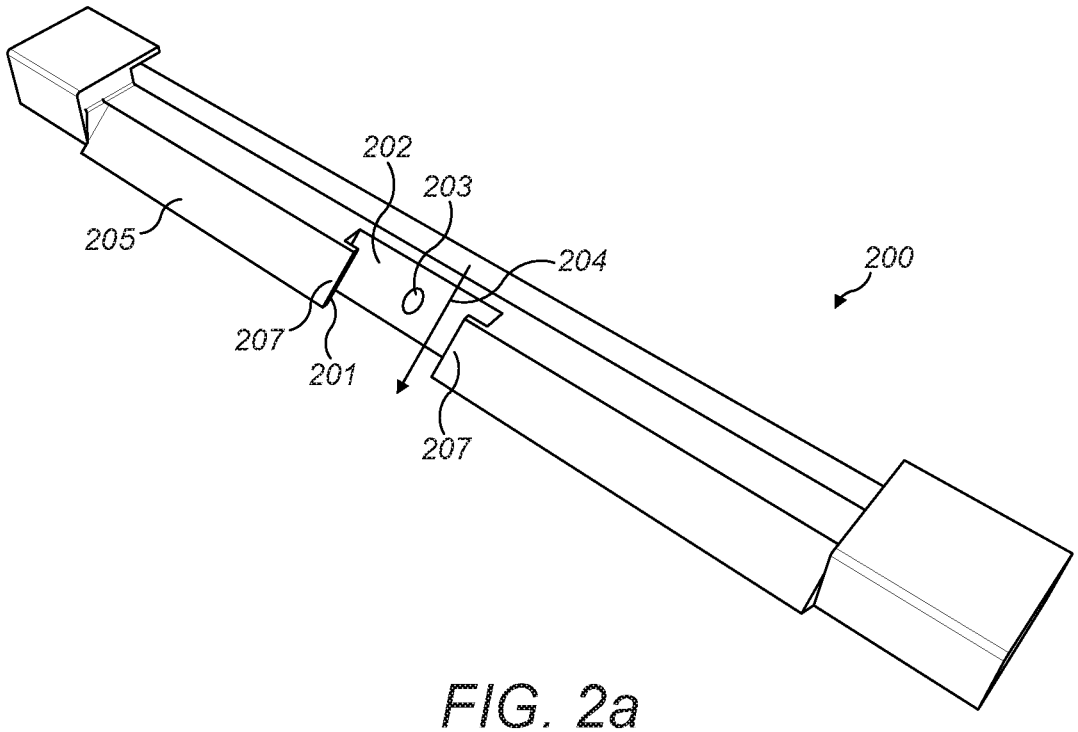
FIG. 2*a* is a schematic perspective diagram of a frame to be attached to a printing device according to an example.
Figure 2B:
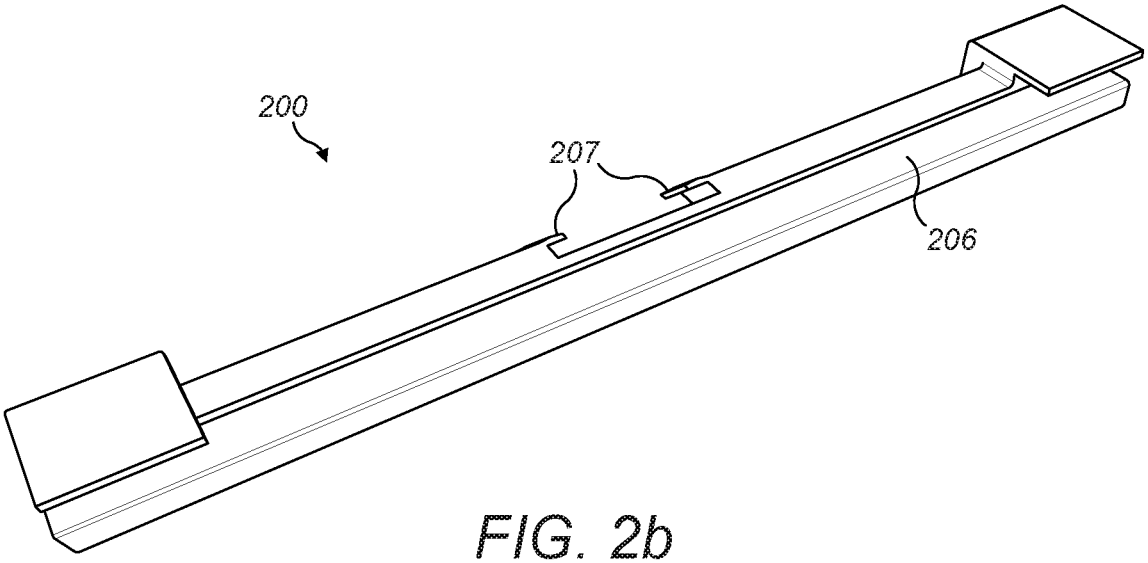
FIG. 2*b* is a schematic diagram of the example frame of FIG. 2*a*, viewed from a rear perspective.

FIGS. 2*a* and *b* schematically illustrate an example frame 200. The frame 200 may include a holding mechanism 206 for fixing the frame 200 to a position at an end of a platen of a printing device. In this example, the holding mechanism 206 defines a recess to receive a rib attached to an end of a platen of a printing device. The frame 200 may also include a threaded hole 203 for receiving a screw. In this example, the threaded hole 203 is on an angled surface 202 of the frame 200.

In this example, the angled surface 202 is on a guiding feature or guide part 201 of the frame 200. The guide part 201 comprises a recess in the frame corresponding to the protruding part of the tensioner, such as the protruding part 104 of the tensioner 100 of FIGS. 1*a-c*, and includes lips 207 that extend from a face surface 205 into the recess, so that the guide part 201 can engage with the protruding part 104 of the tensioner 100 of FIGS. 1*a-c*, for example. In this example, the face surface 205 is a substantially flat surface arranged to be substantially parallel to the plane of the angled surface 202, and the angled surface 202 is at the base of the recess.

Figure 3:
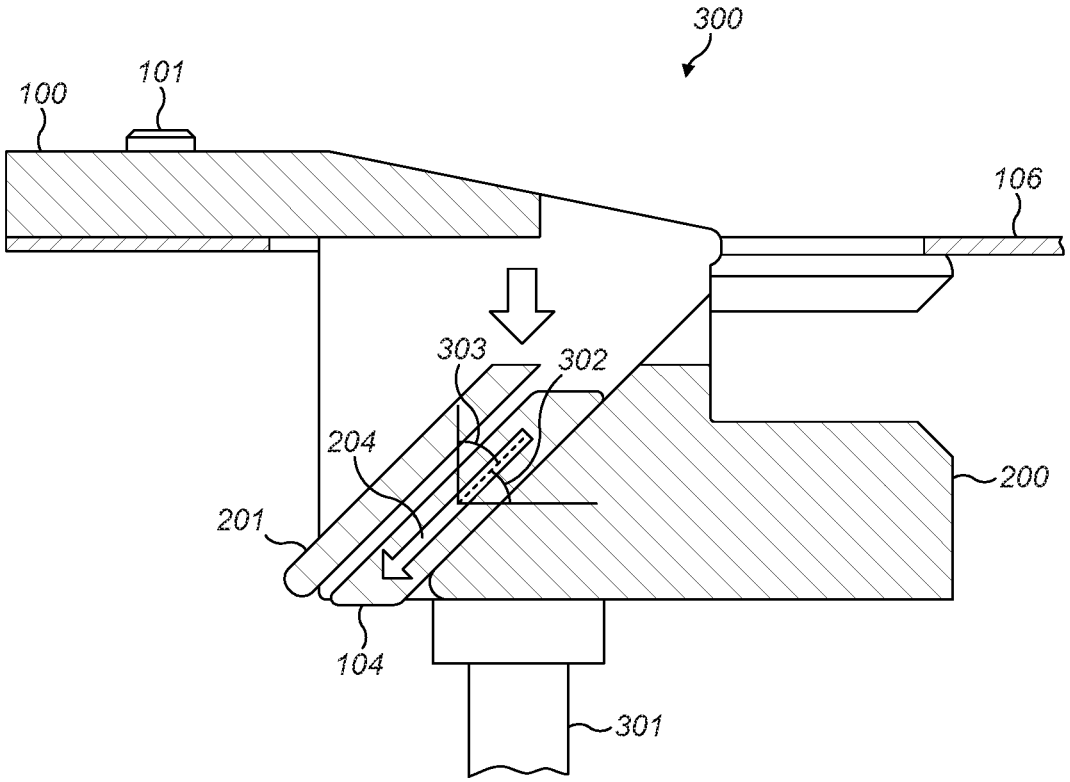
FIG. 3 is a schematic diagram illustrating a tensioner device of FIG. 1*a* fixed onto a frame of FIG. 2*a* according to an example.

FIG. 3 is a diagram illustrating a holder device 300 comprising the tensioner 100, the frame 200 and a screw 301, herein referred to as a tensioner screw 301, according to an example. The tensioner screw 301 allows the tensioner 100 to be fixed to the frame 200. The threaded hole 203 in the frame 200 receives the tensioner screw 301 via the receiving hole 103 passing through the tensioner 100, thereby fixing the tensioner 100 to the frame 200 as illustrated in FIG. 3. In other words, in this example, to fix the tensioner 100 to the frame 200, the tensioner screw 301 is first passed through the receiving hole 103 through the tensioner 100 before engaging with the threaded hole 203 in the frame 200.

In this example, the angled surface 202 of the frame 200 corresponds to the angled surface 102 of the tensioner 100. In the example of FIG. 3, the protruding part 104 of the tensioner 100 is engaged with the guide part 201 of the frame 200 such that the angled surface 102 of the tensioner 100 is substantially in contact with the angled surface 202 of the frame 200. The angled surface 102 of the tensioner 100 is formed to be slidable along the corresponding angled surface 202 on the frame 200 in a direction having an oblique angle 302 with respect to the plane of the edge holder strip 106. The direction along which the tensioner slides is shown by the arrow 204 in FIG. 3.

As mentioned above, the guide part 201 may define a recess, the angled surface 202 of the frame 200 may be at the base of the recess, and the angled surface 102 of the tensioner 100 may be at a front surface of protruding part 104. The centre of the threaded hole 203 may be on the angled surface 202 of the frame, substantially equidistant from the side walls of the recess. The centre of the receiving hole 103 may be substantially equidistant from opposing edges of the protruding part 104, so that the receiving hole 103 and the threaded hole 203 can be aligned to receive the tensioner screw 301 when the protruding part 104 is in the guide part 201.

In this example, the oblique angle 302 formed by the angled surface 102 of the tensioner 100 with respect to the plane of the edge holder strip 106 is substantially the same as the angle 302 formed by the angled surface 202 of the frame 200 with respect to the plane of the edge holder strip 106. The angled surface 102 of the tensioner 100 and the angled surface 202 of the frame 200 are both substantially flat in order to allow the angled surface 102 of the tensioner to slide along the angled surface 202 of the frame in the direction shown by arrow 204. This oblique angle 302 may be between 10 degrees and 45 degrees.

Also, the tensioner screw 301 may be received by the holes 103 and 203 at an angle such that its central axis has an oblique angle 303 with respect to the direction 204. In one example, the central axis of the tensioner screw 301 may be substantially perpendicular to the plane of the edge holder strip 106, and be between 45 and 80 degrees.

As the tensioner screw 301 is tightened, its head pushes down on the tensioner 100, causing the angled surface 102 of the tensioner 100 to slide along the angled surface 202 of the frame 200 in the direction indicated by the arrow 204. In this example, the elongate cross section of the receiving hole 103 allows this movement of the tensioner 100 relative to the frame 200. The receiving hole 103, the threaded hole 203 and the tensioner screw 301 therefore provide an example of an adjustable fixing mechanism, by which the angled surface 102 of the tensioner 100 can be fixed at different position on the angled surface 202 of the frame 200. The displacement of the tensioner 100 provides a tensioning force having a horizontal component in direction parallel to plane of the edge holder strip 106, and a vertical component in a direction pulling downwards on the edge strip holder.

Figure 4:
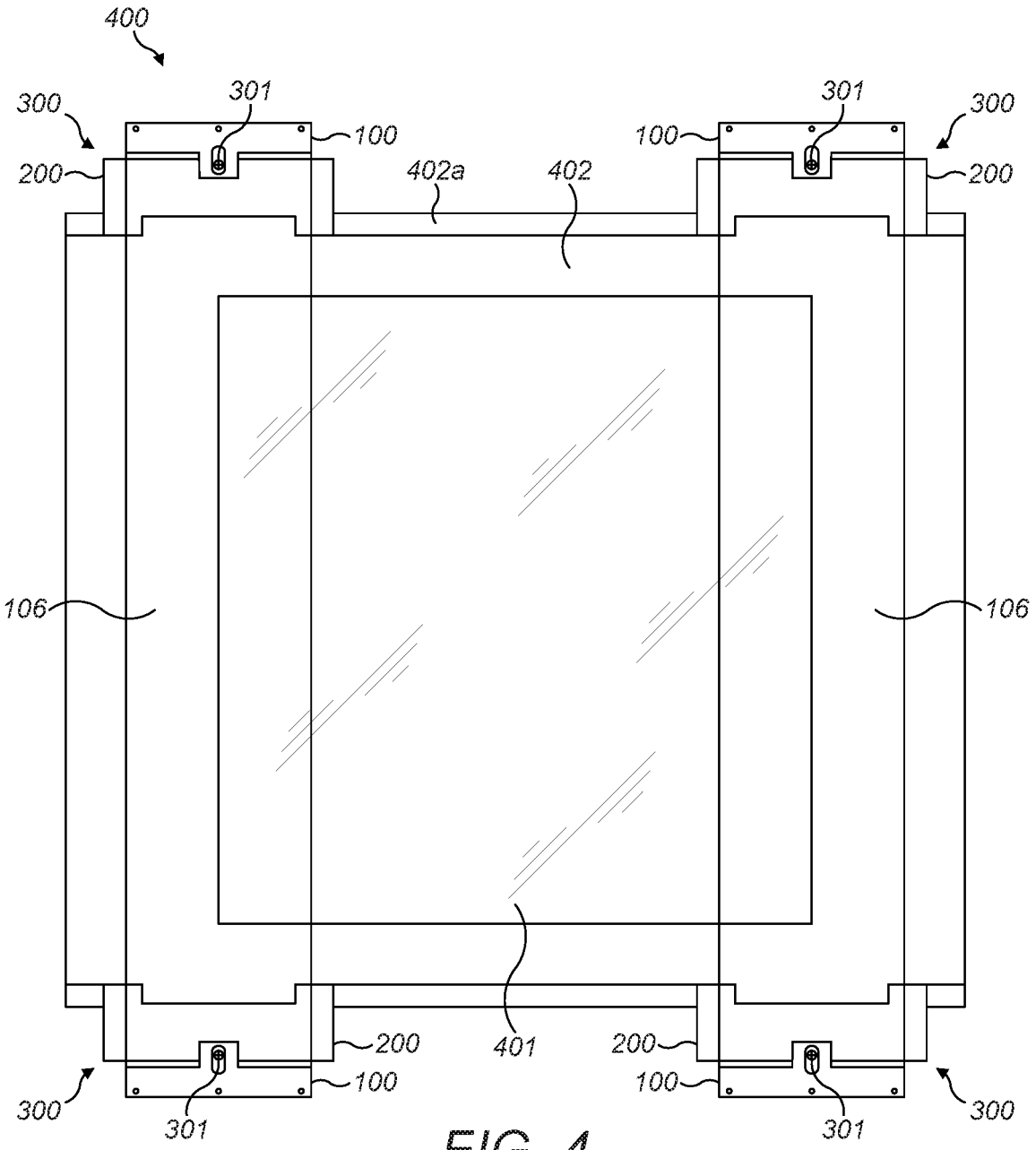
FIG. 4 is a schematic diagram illustrating a first example of a printing system.

FIG. 4 illustrates an example of a printing system 400. The printing system 400 includes a platen 402 for supporting a print target 401. It may also include a pair of frames 200 as described above. For another example, the printing system may include a plurality of pairs of frames 200 where each pair of frames 200 is installed onto respective ribs 402*a* on opposing ends of the platen 402, using the holding mechanism 206 described above, for example. The frames may be placed at predetermined positions, in order to facilitate correct installation by the user. The printing system 400 may also include a pair of tensioners 100 as described above. In another example, the printing system 400 may include a plurality of pairs of tensioners 100, with each tensioner 100 of a pair holding opposite ends of an edge holder strip 106 as per the strip assembly illustrated in FIG. 1*d*. The pairs of tensioners 100 may be fixed to the pairs of frames 200 that are installed onto the opposite ends of the platen 402 using tensioner screws 301. An edge holding strip 106 may be held between each pair of tensioners in a substantially planar configuration across the platen 402 of the printer.

In order to install the strip assembly 111 of FIG. 1*d*, a user may guide the protruding parts 104 of the tensioners 100 on which the angled surface 102 is disposed into the guide parts 201 of the frames 200 on which the angled surface 202 is disposed in order to engage the protruding parts 104 with the guide parts 201. The user may fix, using a pair of tensioner screws 301, the pair of tensioners 100 of the strip assembly 111 onto respective frames 200 fixed to opposing ends of the platen 402. In this way, the strip 106 may be extended across the platen 402 of the printing device.

In order to configure a print target 401 into the printing system 400 ready for printing, the user may loosen the tensioner screws 301 on each pair of tensioners 100 to reduce the tension in the edge holder strips 106 and raise them from the surface of the platen 402. The user may then place a print target 401 onto the platen surface such that the lateral edges of the print target 401 are under the edge holder strips 106 as illustrated in FIG. 4. The user may then tighten the tensioner screws 301 in order to tense the edge holder strips 106 and to press them down onto the surface of the platen 402 in order to hold the edges of the print target 401.

Thus, using the adjustable fixing mechanism for adjusting the displacement of the tensioner 100 as described above, a user may adjust the vertical and horizontal force provided to the edge holder strip 106. For example, a large force may be applied to hold a lateral edge of a print target 401 tightly down onto the platen 402 in order to prevent deformation, such as curling up, of the print target 401. This inhibits such deformation from interfering with the printing process.

The oblique angle 302, relative to the plane of the strip 106, of the angled surface 102 of the tensioner 100 and of the surface 202 of the frame 200 may be varied in order to vary the oblique angle 302 relative to the edge holder strip 106 plane of the direction 204 in which the tensioner 100 slides relative to the frame 200. Adjusting the oblique angle 302 in this way, allows either the horizontal component or the vertical component of the force to be prioritized. The smaller the oblique angle 302, the greater the horizontal component of the force that is imparted for a given amount of movement of the tensioner 100; conversely, the larger the angle 302, the greater the vertical component of the force.

Figure 5:
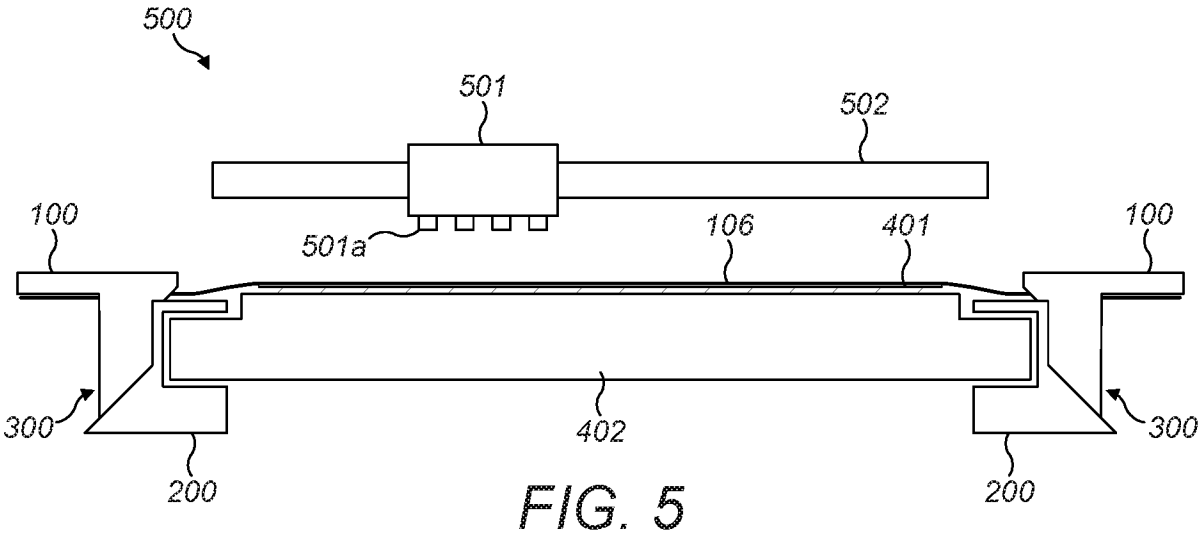
FIG. 5 is a schematic diagram illustrating a second example of a printing system.

FIG. 5 illustrates an inkjet printing system 500 that comprises an inkjet printer with a moveable printing element 501. The moveable printing element 501 is mounted on a movement arm 502, which enables the printing element 501 to move relative to the platen 402. The moveable printing element 501 can therefore deposit printing fluid at different locations on a print target 401 disposed on the platen 402 by ejecting printing fluid, such as ink, from nozzles 501*a*.

The inkjet printing system 500 includes holding devices 300 as described above. Use of the holding device 300 inhibits deformation of the print target 401 as described above. In the case of an inkjet printing system 500, such deformation can lead to the printing element 501 crashing with the edge holder strip 106 and or print target 401, which may, for example, be reduced or prevented by use of the holding device 300 as described herein.

It is to be understood that any feature described in relation to any one example may be used alone, or in combination with other features described, and may also be used in combination with any feature of any other of the examples, or any combination of any other of the examples. Furthermore, equivalents and modifications not described above may also be employed without departing from the scope of the accompanying claims.

What is claimed is:

1. A tensioner device for use with a printing device, the tensioner device comprising:

a holder for holding an end part of a print target holder sheet in a substantially planar configuration across a platen of the printing device;

a first surface formed to slide along a corresponding second surface of a frame attached to the printing device in a first direction having an oblique angle with respect to a plane of the print target holder sheet; and a fixing mechanism to enable the first surface to be fixed to the second surface at different positions along the first direction, wherein the oblique angle is between 10 degrees and 45 degrees.

2. A tensioner device according to claim 1, wherein the first surface comprises a substantially flat surface.

3. A tensioner device according to claim 1, wherein the fixing mechanism comprises a structure defining a hole passing through the tensioner device for receiving a screw.

4. A tensioner device according to claim 3, where the screw is received at an angle such that the screw has an oblique angle with respect to the first direction.

5. A tensioner device according to claim 3, wherein the hole has an elongate cross section having a length lying along a direction substantially perpendicular to an edge of the print target holder sheet held in the holder, and a width shorter than the length.

6. A tensioner device according to claim 3, wherein the hole passes through the first surface.

7. Apparatus for use with a printing device, the apparatus comprising:

a first part comprising:

a holder to hold an edge holder strip for holding an edge of a print target on a platen of the printing device;

a first structure defining a first hole passing through the first part for receiving a screw; and a first surface; and a second part attachable to the printing device, the second part comprising:

a second structure defining a second hole for receiving the screw via the first hole, the second structure forming threads in the second hole; and a second surface slidable along the first surface in a direction having an oblique angle with respect to an angle at which the screw is received.

8. Apparatus according to claim 7, wherein each of the first surface and the second surface is substantially flat.

9. Apparatus according to claim 7, wherein the first surface is on a protruding part of the first part, the second surface is on a guide part of the second part, and the protruding part is arranged to fit in the guide part.

10. Apparatus according to claim 9, wherein the guide part comprises a structure defining a recess and lips protruding into the recess to receive the protruding part.

11. Apparatus according to claim 7, wherein the oblique angle is between 45 degrees and 80 degrees.

12. A printing system, comprising;

a platen for supporting a print target;

a print target holder sheet extending across the platen, for holding the print target to the platen;

holder devices holding opposing ends of the print target holder sheet, at least one of the holder devices comprising:

a first part holding an end part of the print target holder sheet, the first part comprising a first surface;

a second part fixed to a position at an end of the platen, the second part comprising a second surface corresponding to the first surface of the first part; and an adjustable fixing mechanism, the adjustable fixing mechanism being adjustable to fix the first surface to the second surface at different positions along the first direction, the second surface being slidable along the first surface in a first direction having an oblique angle with respect to a plane of the platen, wherein the adjustable fixing mechanism comprises a screw passing through the first part into a threaded hole in the second part.

13. A printing system according to claim 12, comprising an inkjet printer having a moveably-mounted printing element.

* * * * *